US010301056B2

(12) United States Patent
Paredes

(10) Patent No.: US 10,301,056 B2
(45) Date of Patent: May 28, 2019

(54) CONTAINER HAVING PRIMARY AND SECONDARY SUPPORT SURFACES

(75) Inventor: Raul M. Paredes, Perrysburg, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 368 days.

(21) Appl. No.: 13/606,996

(22) Filed: Sep. 7, 2012

(65) Prior Publication Data

US 2014/0069884 A1 Mar. 13, 2014

(51) Int. Cl.

*B65D 1/10* (2006.01)
*B65D 21/02* (2006.01)
*B65D 1/02* (2006.01)

(52) U.S. Cl.

CPC ..... *B65D 1/10* (2013.01); *B65D 1/0223* (2013.01); *B65D 1/0261* (2013.01); *B65D 21/0217* (2013.01); *B65D 21/0219* (2013.01); *B65D 2207/00* (2013.01); *B65D 2501/0081* (2013.01)

(58) Field of Classification Search

CPC .. B65D 1/10; B65D 21/0217; B65D 21/0219; B65D 1/0261; B65D 2501/0081

USPC ..... 220/631, 628, 606, 604, 638, 633, 635, 220/23.6, 669–671, 675; 215/376, 372, 215/371, 373, 382, 377, 374, 375; 40/310

See application file for complete search history.

(56) References Cited

U.S. PATENT DOCUMENTS

| | | | | | |
|---|---|---|---|---|---|
| 86,712 | A | * | 2/1869 | Fuerst | 24/17 R |
| 279,915 | A | * | 6/1883 | Clark | 431/324 |
| 1,659,383 | A | * | 2/1928 | Thiene et al. | 422/556 |
| 1,752,291 | A | | 4/1930 | Barbiers | |
| D86,712 | S | | 4/1932 | Fuerst | |
| D99,011 | S | | 3/1936 | Garwood | |
| D99,012 | S | | 3/1936 | Garwood | |
| 2,121,165 | A | * | 6/1938 | Slobodkin | 220/574 |
| 2,272,262 | A | * | 2/1942 | Carter | 40/311 |
| D134,307 | S | | 11/1942 | Loewy | |
| 2,596,034 | A | * | 5/1952 | Lambert, Jr. | 422/92 |
| D175,196 | S | | 7/1955 | Suttle | |
| 2,793,788 | A | * | 5/1957 | Lysne | 220/631 |
| 3,100,054 | A | | 8/1963 | Rubens | |
| D204,705 | S | | 5/1966 | Birrell et al. | |
| 4,119,244 | A | * | 10/1978 | Funke | 222/400.8 |

(Continued)

FOREIGN PATENT DOCUMENTS

| | | |
|---|---|---|
| BE | 714017 | 9/1968 |
| CA | 2282202 A1 | 3/2000 |

(Continued)

OTHER PUBLICATIONS

Website Printout—Glass Tilt Jar with Aluminum Lid—Hobby Lobby, http://shop.hobbylobby.com/store/item.aspx?ItemId=152811,1 page.

(Continued)

*Primary Examiner* — Andrew T Kirsch
*Assistant Examiner* — Don M Anderson

(57) ABSTRACT

A container includes a body including a primary support surface, a sidewall including at least one secondary support surface at an angle to the primary support surface and to a longitudinal axis of the container, and a finish extending from the body coaxially with the longitudinal axis. The container may be tilted from the primary support surface to the secondary support surface to facilitate access to product carried in the container.

17 Claims, 9 Drawing Sheets

(56) References Cited

U.S. PATENT DOCUMENTS

| | | | | | |
|---|---|---|---|---|---|
| 5,071,277 | A * | 12/1991 | Braun | 401/126 |
| D357,629 | S | 4/1995 | Weiss | |
| D361,515 | S * | 8/1995 | Caron | D9/522 |
| D370,834 | S | 6/1996 | Hartman | |
| 5,740,914 | A * | 4/1998 | Herzog | 206/501 |
| D404,259 | S | 1/1999 | Tisdale | |
| D500,640 | S | 1/2005 | Lawson et al. | |
| 7,017,773 | B2 * | 3/2006 | Gruber et al. | 220/675 |
| 7,087,298 | B2 * | 8/2006 | Key | 428/343 |
| D576,883 | S | 9/2008 | Carapelli | |
| D584,154 | S | 1/2009 | Fitzsimmons et al. | |
| D633,804 | S | 3/2011 | Podewski | |
| 2010/0155281 | A1 * | 6/2010 | Tuominen et al. | 206/409 |
| 2012/0187069 | A1 | 7/2012 | Harris et al. | |

FOREIGN PATENT DOCUMENTS

| | | | |
|---|---|---|---|
| CA | 2649163 | A1 | 6/2010 |
| CN | 2334687 | Y | 8/1999 |
| CN | 201239071 | Y | 5/2009 |
| EP | 0987181 | A2 | 3/2000 |
| EP | 2892811 | A1 | 7/2015 |
| GB | 2353266 | A | 2/2001 |
| JP | 2001273933 | A | 10/2001 |

OTHER PUBLICATIONS

Website Printout—Vintage Tilt Jar with Glass Lid for Candy Cookies or other Goodies, http://www.etsy.com/listing/37188436/vintage-tilt-jar-with-glass-lid-for, 1 page.

Website Printout—Tilted Glass Storage Jar—Origin Crafts, Unique & Themed Decor, www.origincrafts.com/oc02088.html, 1 page.

PCT Notification of Transmittal of The International Search Report and The Written Opinion of the International Searching Authority, or the Declaration PCT Int App No. PCT/US2013/053362 Filed: Aug. 2, 2013 dated Nov. 4, 2013.

Australian Examination Report No. 1, Application No. 2016277695, Applicant: Owens-Brockway Glass Container Inc., dated Mar. 7, 2018.

Chinese Search Report, Application No. 201611205784.7, Applicant: Owens-Brockway Glass Container Inc., dated Feb. 5, 2018.

European Extended Search, Application No. 17180499.0, Applicant: Owens-Brockway Glass Container Inc., dated Oct. 19, 2017.

* cited by examiner

CONTAINER HAVING PRIMARY AND SECONDARY SUPPORT SURFACES

The present disclosure is directed to containers and, more particularly, to a container with a label.

BACKGROUND AND SUMMARY OF THE DISCLOSURE

Containers often include a body and a neck finish extending axially from the body to accept a closure. The body usually includes a base, a sidewall extending axially away from the base, and a shoulder between the sidewall and the neck finish. The neck finish typically includes circumferentially extending threads or lugs to cooperate with corresponding features of the closure. U.S. patents that illustrate glass containers of this type include U.S. Pat. No. 2,688,823 and U.S. Pat. No. 3,738,524.

A general object of the present disclosure, in accordance with one aspect of the disclosure, is to provide a container having improved gripping or cradling characteristics, and having a primary support surface and an angled secondary support surface onto which the container can be tilted to facilitate access to partially consumed and diminishing product in the container.

The present disclosure embodies a number of aspects that can be implemented separately from or in combination with each other.

A container in accordance with one aspect of the disclosure includes a base defining a flat primary support surface, a body extending from the base, and a finish extending from the body coaxially with the base around a base/finish axis. The body has a sidewall having at least one secondary support surface at an angle to the primary support surface and to the axis, and a surface of revolution around the axis between the secondary support surface and the finish.

In accordance with another aspect of the disclosure, there is provided a container that has a longitudinal axis and that includes a body and a neck finish extending from the body along and coaxial with the longitudinal axis. The body includes a base having a primary support surface, and a sidewall extending from the base and including a facet. The facet has a secondary support surface oriented at a tilt angle that is acute with respect to the axis and obtuse with respect to the primary support surface. The facet also has a recessed portion within the secondary support surface. The neck finish includes a cylindrical outer surface and one or more closure engagement features on the cylindrical outer surface.

BRIEF DESCRIPTION OF THE DRAWINGS

The disclosure, together with additional objects, features, advantages and aspects thereof, will be best understood from the following description, the appended claims and the accompanying drawings, in which:

DETAILED DESCRIPTION OF PREFERRED EMBODIMENTS

Figure 1:
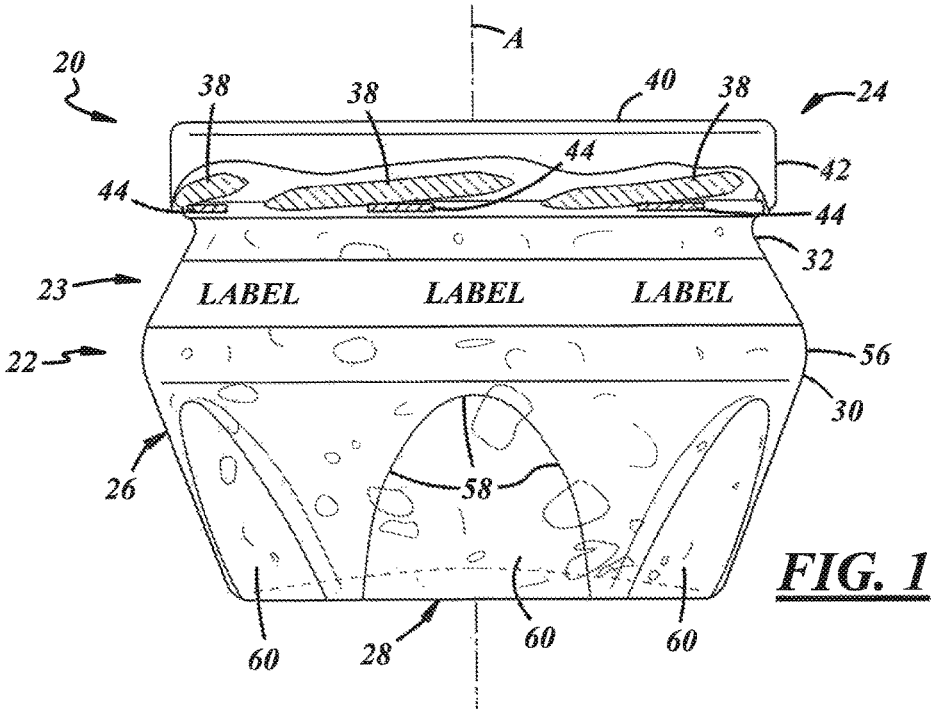
FIG. 1 is a fragmentary, elevational view of a package including a container, a container label, and a closure in accordance with an illustrative embodiment of the present disclosure, wherein the container is resting on a primary support surface and is filled with product.

FIG. 1 illustrates a package 20 including a container 22 having a longitudinal axis A, a container label 23 carried by the container 22, and a closure 24 that may be coupled to the container 22 along the axis A. The package 20 may be used to package salsa, dip, sauce, pickles, baby food, peppers, jam, or any other food products. The closure 24 may be composed of metal and/or polymeric material(s), or any other material(s) suitable for enclosing food products. The label 23 may be integral with the container 22, for example, printed thereon, or may be separate therefrom and composed of paper, plastic, or any other material suitable for labeling a container. The container 22 may be composed of glass, or any other material suitable for containing food products. A plurality of the package 20 are stackable, one atop another.

The container 22 may be provided in any suitable sizes, and may include a jar, a wide mouth type of container, or the like. The container 22 includes a body 26 including a base 28, and a sidewall 30 extending in a direction axially away from the base 28 in a direction generally along the axis A. As used herein, the terminology "axially away" does not necessarily mean parallel with the axis A and is used to indicate the general direction. The body 26 also may include a surface of revolution concentric with the axis A for securement of the label 23. In the embodiment of FIGS. 1-5, the surface of revolution may include a shoulder 32 extending from the sidewall 30, as illustrated in the Figures. In the embodiment illustrated in FIG. 1, the surface of revolution may be frusto-conical, may extend 360 degrees of revolution around the axis A, and may allow for labeling according to standard labeling operations. In other embodiments, however, the container body 26 need not include a shoulder. As used herein, directional words such as top, bottom, upper, lower, radial, circumferential, lateral, longitudinal, transverse, vertical, horizontal, and the like are employed by way of description and not necessarily limitation.

Figure 2:
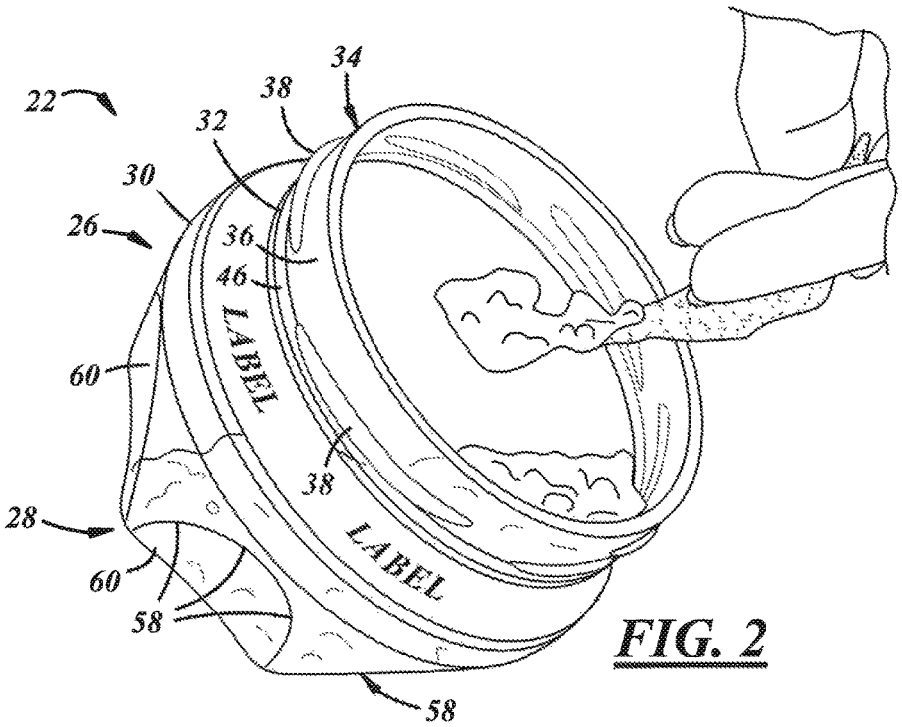
FIG. 2 is a perspective view of the container and container label of FIG. 1 with the closure removed, wherein the container has been tilted onto a secondary support surface to facilitate access, via a hand-held chip, to partially consumed product in the container.
Figure 3:
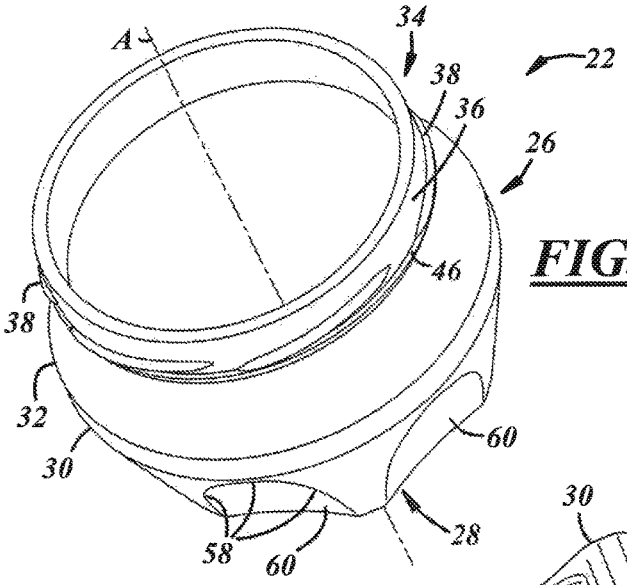
FIG. 3 is a perspective view of the container of FIG. 1 without the container label and closure.
Figure 4:
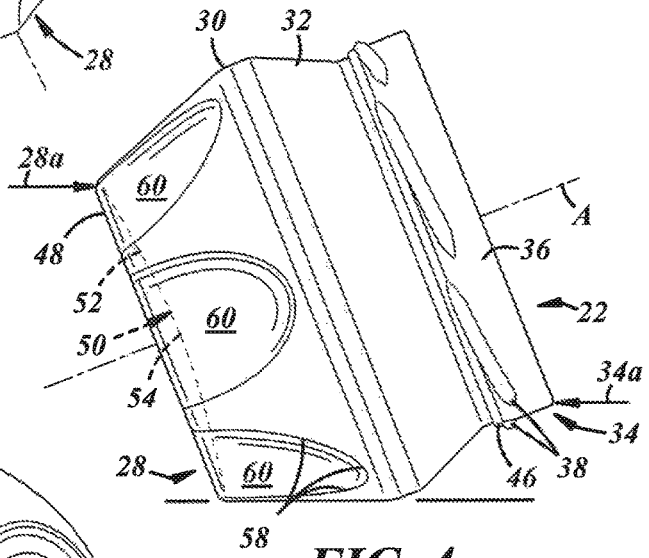
FIG. 4 is an elevational view of the container of FIG. 1 without the container label and closure.

Referring to FIGS. 2 through 4, the container 22 includes a neck finish 34 extending in a generally axial direction from the body 26 around the axis A, and establishing an open mouth or opening of the container 22 around the axis A. More particularly, the neck finish 34 may extend from the shoulder 32 of the sidewall 30, and may extend coaxially with the base 28 around the axis A. In other embodiments, however, where the container body 26 does not include a shoulder, the neck finish 34 may extend directly from the sidewall 30. The neck finish 34 includes an outer surface 36 that may be cylindrical over 360 degrees of revolution about the axis A, and one or more closure engagement features that may include lugs, bayonets, thread segments 38, or any other suitable features, on the outer surface 36. As used herein, the term thread segment includes whole, partial, multiple, and/or an interrupted thread and/or thread segment. The thread segments 38 may include six, or any other suitable quantity of, thread segments 38. In any case, the thread segments 38 may extend circumferentially around the neck finish 34. In this regard, and with reference to FIG. 1, the closure 24 may include a base wall 40, a skirt 42 depending axially from the base wall 40 and having a plurality of container engagement elements that may include threads, lugs 44, or any other suitable features, and may be equal in number to the plurality of external thread segments 38. In one embodiment, the closure 24 may be rotatably coupled to the container 22 about and along the axis A. The neck finish 34 also may include a capping flange 46 extending completely circumferentially around the neck finish 34 and oriented axially between the thread segments 38 and the body shoulder 32.

Figure 5:
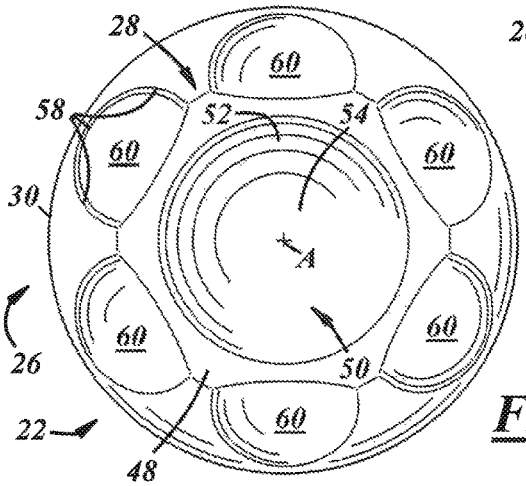
FIG. 5 is an enlarged bottom view of the container of FIG. 1.

With reference to FIG. 5, the base 28 may define or include a primary support surface 48 that may be flat and may be shaped as shown in FIG. 5. The primary support surface 48 may—but need not—be circumferentially continuous, and not interrupted, as shown in FIG. 5. The base 28 also may be recessed, for example, to have a push-up 50. The push-up 50 may be concave and may include an incurvate surface 52 and a flat surface 54 radially inward of the incurvate surface 52.

With respect to FIG. 1, the sidewall 30 may be generally rounded, generally straight, or of any other general outer profile but is preferably generally frusto-conical from a radial apex 56 to the base 28. Although the sidewall 30 need not be flat or straight, the sidewall 30 may be generally oriented at an angle that is obtuse with respect to the base 28 and acute with respect to the axis A. The sidewall 30 may be faceted, and, in some embodiments including the present embodiment, may be multi-faceted. In any case, the sidewall 30 includes at least one secondary support surface 58 that establishes a plane oriented at an angle to the primary support surface 48 (FIG. 5) and to the axis A. As used herein, the terminology "at an angle" means at a non-zero angle.

As shown in FIGS. 1 through 5, the at least one secondary support surface 58 includes a plurality secondary support surfaces 58, for example, six secondary support surfaces 58. Any suitable quantity of secondary support surfaces 58 may be provided, for example, 1, 2, 6, or any other suitable quantity. The multiple secondary support surfaces 58 may be equidistantly circumferentially spaced in an array about the axis A. The secondary support surface 58 may include a surface-defining periphery with an edge lying in a plane at a tilt angle to the axis A.

In one embodiment, the sidewall facet may be recessed, for instance, to eliminate wobbling and provide good stability of the container 22 when it rests on its secondary support surface 58. For example, the sidewall facet may be recessed via a concave surface 60 oriented within the periphery of the secondary support surface 58. But the sidewall facet may be recessed via stepped surfaces, angled surfaces, or in any other suitable manner. In any case, the secondary support surface 58 and corresponding recessed portion may constitute a single sidewall facet. In other embodiments, the sidewall facet may be continuously planar, for example, wherein a secondary support surface is a continuously planar surface.

The secondary support surface 58 intersects the base 28 and/or primary support surface 48 at a tilt angle with respect to the axis A and at an obtuse angle with respect to the base 28 and/or primary support surface 48. The secondary support surface 58 may be of conic sectional shape, for example, parabolic, hyperbolic, elliptic, or the like, when viewed from a perpendicular angle thereto. In any event, the secondary support surface 58 has an wide end that may intersect the primary support surface 48 of the base 28, exemplified by FIG. 5.

With reference to FIGS. 1-4, the surface of revolution 32 for the label 23 may extend circumferentially around the axis A, and longitudinally along the axis A between the secondary support surface(s) 58 and the finish 34 for securement or carrying of the label 23. The surface of revolution 32 may be conical, and/or may be oriented at an angle that is obtuse with respect to the secondary support surface 58 and acute with respect to the longitudinal axis A. The label 23 may be secured to or carried by the surface of revolution 32, for example, by adhesion, shrink-wrap, or in any other suitable manner. The label 23 may be a wrap-around label and may extend entirely around the surface of revolution 32 for at least 360 degree coverage.

Referring to FIG. 1, one or more of the thread segments 38 may be oriented in a predetermined circumferential relationship with the secondary support surfaces 58 so that the package 20 can be oriented on any one of its plurality secondary support surfaces 58 at a point of sale, wherein an overall level orientation of graphics on the base 40 of the closure 24 will be within in plus or minus fifteen degrees of rotation with respect to a horizontal surface of a store shelf when properly faced by a stocker at a store. In that way, a potential customer of the product will not have to tilt their head to an unacceptable degree to read the closure graphics. For example, the closure lugs 44 can be circumferentially aligned with the secondary support surfaces 58. More specifically, a circumferential center of each thread segment 38 (and thus each closure lug 44 when fully applied to the container 22) may be circumferentially aligned with a circumferential center of a corresponding secondary support surface 58. The quantity of external thread segments 38 and lugs 44 may be equal in number to the plurality of secondary support surfaces 58.

In use, and with reference to FIG. 1, the closure 24 may be removed from the container 22, the container 22 may be rested on its base 28, and product in the container 22 may be consumed, for example, by dipping chips or the like into the container 22 to remove product therefrom for consumption. Product may be progressively removed from the container to a point at which it becomes frustratingly difficult for a consumer to remove additional product.

At that point, and with reference to FIG. 2, the consumer may tilt the container 22 from the primary support surface 48 to one of the secondary support surfaces 58 to facilitate removal of the remaining product, wherein product may flow under the force of gravity toward the open container mouth.

With reference to FIG. 4, the container 22 is constructed such that when the secondary support surface 58 of the container 22 rests flat on a horizontal surface, a lowermost portion 34*a* of the finish 34 is lower than an uppermost portion 28*a* of the base 28. Compare the straight reference arrow for portion 28*a* with the straight reference arrow for portion 34*a*. In one embodiment, the size and configuration of the container 22 may be such that 25% to 40% of the product by volume can be retained in the container 22 without spillage when the container 22 rests on the secondary support surface 58. In a more particular embodiment, the size and configuration of the container 22 may be such that 30% to 35% of the product by volume can be retained in the container 22 without spillage when the container 22 rests on the secondary support surface 58.

For example, in the example embodiment illustrated in FIGS. 1 through 5, a full capacity of the container 22 resting on its base 28 may be 16 to 17 ounces, and a tilt capacity of the container 22 resting on its secondary support surface 58 may be 5 to 5.5 ounces. Also, the finish opening diameter may be about 100 mm, the major diameter of the container 22 at the sidewall radial apex 56 may be about 110 mm, the radially outermost diameter of the base 28 may be about 78 mm for good stacking radially within a 100 mm closure, the height of the push-up 50 may be about 5 mm, the overall height of the container 22 from the base 28 to the finish open mouth may be about 81 mm, the distance from the base 28 to the sidewall radial apex 56 may be about 42 mm, the distance from the base 28 to the finish 34 may be about 65 mm, and the angle of the secondary support surface 58 with respect to the axis A may be about 32 degrees wherein the container 22 can be tilted about 58 degrees from the base 28 to the secondary support surface 58. Also, the thicknesses of the container walls may be of any suitable values customary in the art. As used herein the term "about" includes plus or minus 1-10% and all ranges and subranges therebetween.

The container 22 has good ergonomic characteristics wherein the container 22 can be comfortably gripped or cradled by a consumer. The multi-faceted and generally inverted frusto-conical shape of the sidewall 30 and the concave push-up 50 facilitate a good grip on the container 22 by a consumer. Such features may contribute to an improved consumer experience with the container 22.

FIGS. 6 through 9 illustrate another illustrative embodiment of a package 120 and/or a container 122 for the package 120. This embodiment is similar in many respects to the embodiments of FIGS. 1-5 and like numerals between the embodiments generally designate like or corresponding elements throughout the several views of the drawing figures. Accordingly, the descriptions of the embodiments are incorporated into one another. Additionally, the description of the common subject matter generally may not be repeated here.

Figure 6:
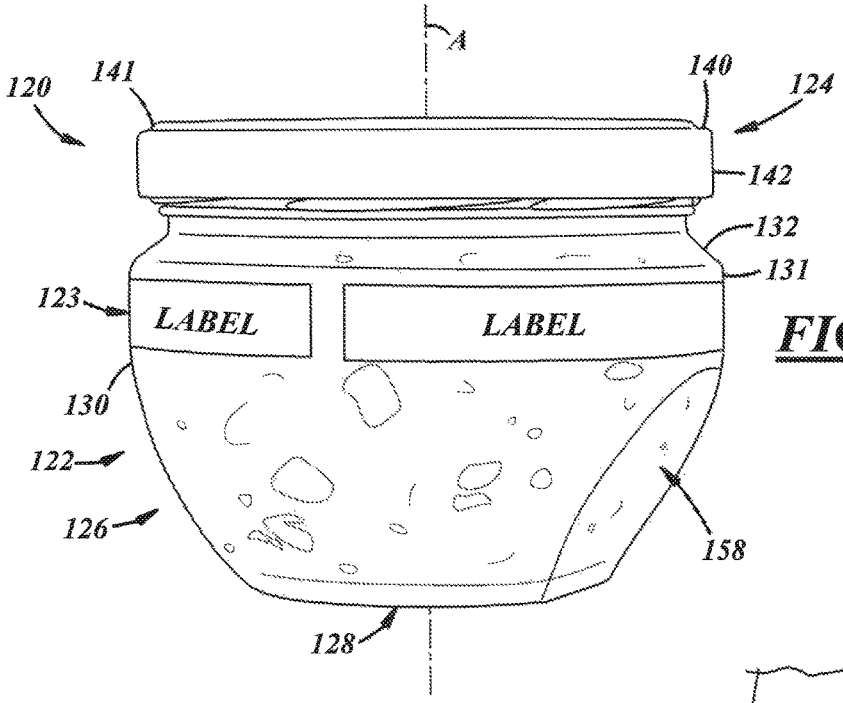
FIG. 6 is a side elevational view of a package including a container, container label, and a closure in accordance with another illustrative embodiment of the present disclosure, wherein the container is resting on a primary support surface and is filled with product.

With reference to FIG. 6, the package 120 includes a container 122, a label 123 on the container 122, and a closure 124 coupled to the container 122. The container 122 includes a body 126 including a base 128, a sidewall 130 extending in a direction axially away from the base 128, and a shoulder 132. The container 122 also has a longitudinal axis A, and includes a neck finish 134 extending from the shoulder 132 of the body 126.

Figure 9:
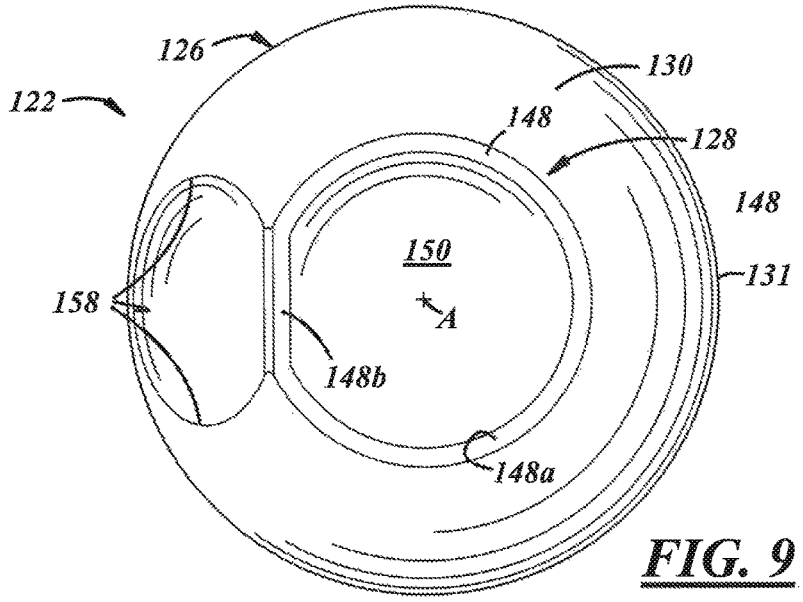
FIG. 9 is an enlarged bottom view of the container of FIG. 6.

With reference to FIG. 9, the base 128 may define or include a primary support surface 148 that may be flat to establish a plane. The primary support surface 148 may be shaped as shown in FIG. 9, including a semi-circumferential portion 148*a* and a straight portion 148*b*. The base 128 also may be recessed, for example, to have a push-up 150. The push-up 150 may be concave.

Figure 7:
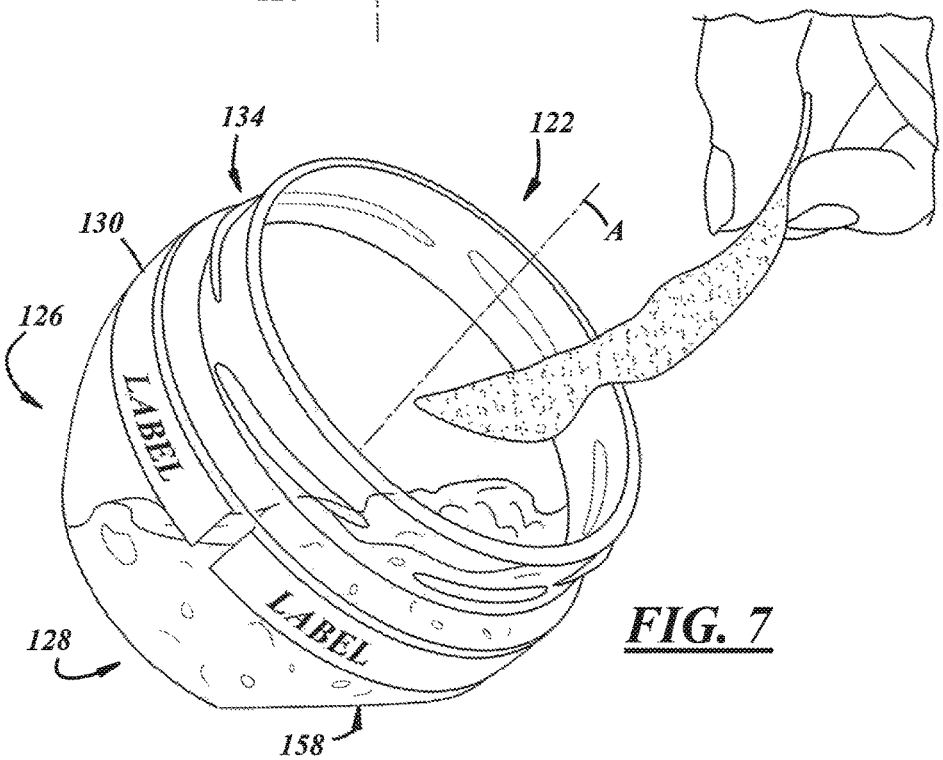
FIG. 7 is a perspective view of the container and container label of FIG. 6 with the closure removed, wherein the container has been tilted onto a secondary support surface to facilitate access, via a hand-held chip, to partially consumed product in the container.
Figure 8:
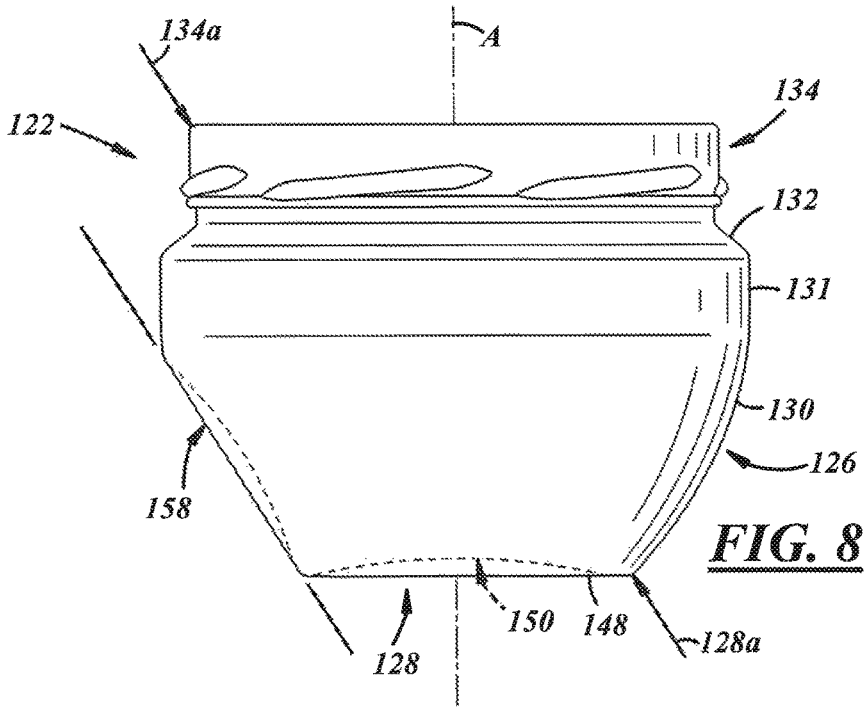
FIG. 8 is an elevational view of the container of FIG. 6 without the container label and closure.

Referring to FIGS. 6-8, the sidewall 130 may have a generally bowl-shaped or rounded outer profile and may include a surface of revolution to which the label 123 may be applied or carried on. The surface of revolution may be substantially cylindrical and may extend over 360 degrees of revolution around the axis A. The sidewall 130 may be faceted, for example, to include at least one secondary support surface 158 that establishes a plane oriented at a non-zero angle to the primary support surface 148 (FIG. 8) and to the axis A. The facet may be continuously planar, for example, wherein the secondary support surface 158 may be a continuously planar surface. But in other embodiments, like the embodiment illustrated in FIGS. 8 and 9, the facet may be recessed or concave wherein the secondary support surface 158 may be a peripheral rim oriented outside of a concave surface.

The secondary support surface 158 may intersect the base 128 at a tilt angle with respect to the axis A and at an obtuse angle with respect to the base 128. The secondary support surface 158 may be of conic sectional shape, for example, parabolic, hyperbolic, elliptic, or the like. In any event, the secondary support surface 158 may have a lower or open end that may intersect the primary support surface 148 of the base 128, exemplified by FIG. 9. With reference to FIG. 7, the consumer may tilt the container 122 from the base 128, and/or a primary support surface thereof, to the secondary support surface 158 to facilitate removal of the remaining product, wherein product may flow under the force of gravity toward the open container mouth.

With reference to FIG. 8, the container 122 is constructed such that when the secondary support surface 158 of the container 122 rests flat on a horizontal surface, a lowermost portion 134*a* of the finish 134 is lower than an uppermost portion 128*a* of the base 128. Compare the straight reference arrow for portion 128*a* with the straight reference arrow for portion 134*a*.

The surface of revolution 131 for the label 123 may extend circumferentially around the axis A, and longitudinally along the axis A between the secondary support surface 158 and the finish 134 for securement or carrying of the label 123.

With reference to FIG. 6, the closure 124 has a raised peripheral edge 141 and the base 128 of the container 122 has a maximum external dimension receivable within the raised peripheral edge 141 such that a plurality of the package 120 can be stacked upon each other. The raised peripheral edge 141 can be an annular projection that extends circumferentially around the closure 124 and that prevents the base 128 of another package from slipping off of the closure 124 in radial direction.

Figure 10:
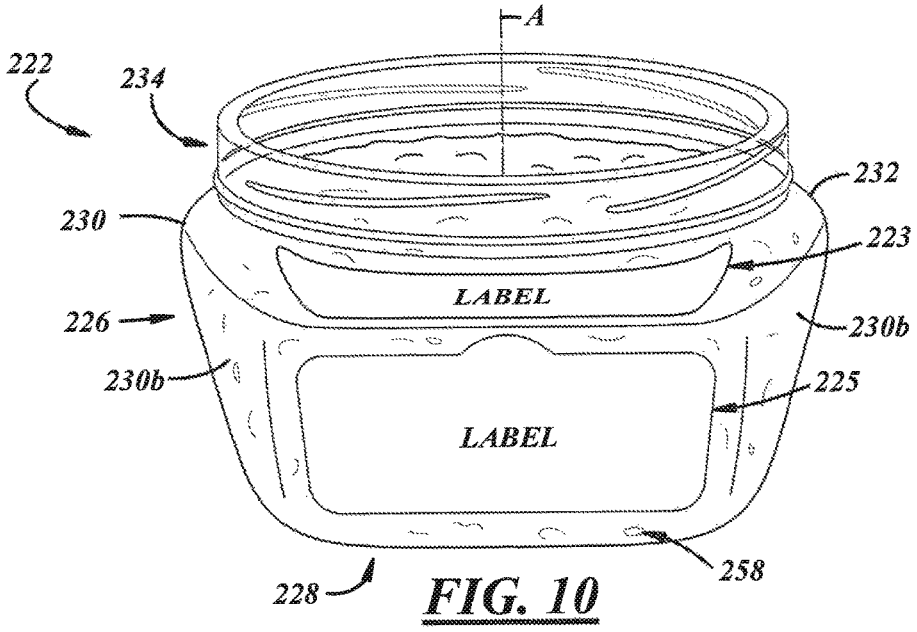
FIG. 10 is a front perspective view of a package including a container and container labels in accordance with a further illustrative embodiment of the present disclosure, wherein the container is resting on a primary support surface and is filled with product.
Figure 11:
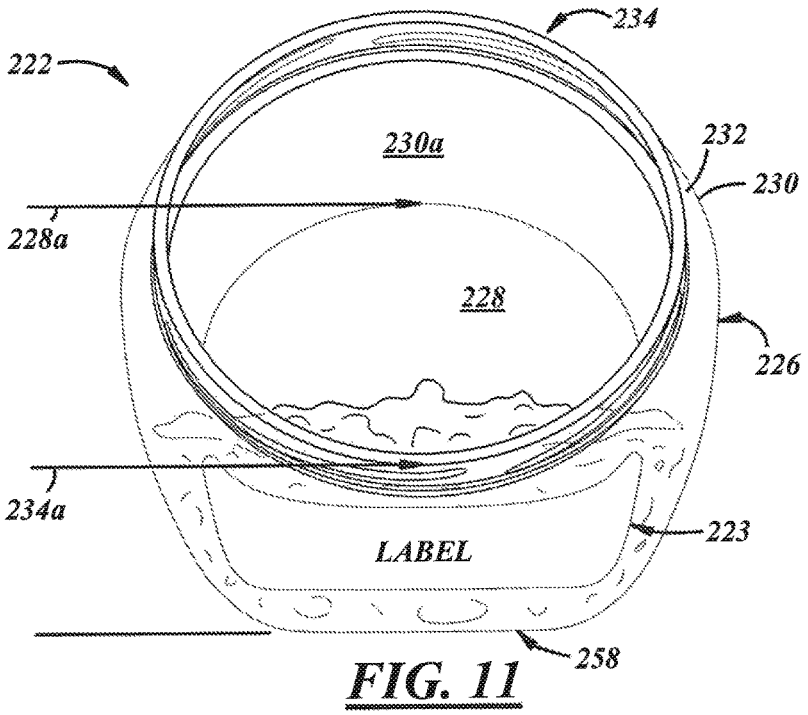
FIG. 11 is another front perspective view of the container and one of the container labels of FIG. 10, wherein the container has been tilted onto a secondary support surface to facilitate access to partially consumed product in the container.

FIGS. 10 and 11 illustrate another illustrative embodiment of a container 222. This embodiment is similar in many respects to the embodiments of FIGS. 1-9 and like numerals between the embodiments generally designate like or corresponding elements throughout the several views of the drawing figures. Accordingly, the descriptions of the embodiments are incorporated into one another. Additionally, the description of the common subject matter generally may not be repeated here.

FIG. 10 illustrates the container 222, and a first label 223 and a second label 225 on the container 222. The container 222 includes a body 226 including a base 228, a sidewall 230 extending in a direction axially away from the base 228, and a shoulder 232. The container 222 also has a longitudinal axis A, and includes a neck finish 234 extending from the shoulder 232 of the body 226.

The base 228 may define or include a primary support surface that may be flat to establish a plane. The primary support surface may be continuously planar, or may be recessed, for example, to have a push-up (not shown), which may be concave.

The sidewall 230 may have a generally rounded or bowl-shaped back portion 230*a*, and generally angled side portions 230*b* extending from the back portion 230*a*. The sidewall 230 may be faceted, for example, to include at least one secondary support surface 258 that establishes a plane oriented at a non-zero angle to the primary support surface or base 258 and to the axis A. The secondary support surface 258 may extend between the angled side portions 230*b*. The facet may be continuously planar, for example, wherein the secondary support surface 258 is a continuously planar surface but, in other embodiments, the facet may be recessed or concave wherein the secondary support surface 258 may be a peripheral rim oriented outside of a concave surface. In any case, the secondary support surface 258 may carry the second label 225. The secondary support surface 258 may intersect the base 228 at a tilt angle that is acute with respect to the axis A and obtuse with respect to the base 228. The secondary support surface 258 may be of generally rectangular shape, exemplified by FIG. 10.

With reference to FIG. 11, the consumer may tilt the container 222 from the base 228, and/or a primary support surface thereof, to the secondary support surface 258 to facilitate removal of the remaining product, wherein product may flow under the force of gravity toward the open container mouth. The container 222 is constructed such that when the secondary support surface 258 of the container 222 rests flat on a horizontal surface, a lowermost portion 234*a* of the finish 234 is lower than an uppermost portion 228*a* of the base 228. Compare the straight reference arrow for portion 228*a* with the straight reference arrow for portion 234*a*.

The shoulder 232 may include a surface of revolution for securement of the label 223. In the embodiment illustrated in FIG. 10, the surface of revolution may be frusto-conical. The surface of revolution for the label 223 may extend circumferentially around the axis A, and longitudinally along the axis A between the secondary support surface 258 and the finish 234 for securement or carrying of the label 223. The shoulder 232 also may include an extension at the front of the container 222 that extends from the surface of revolution and accepts the label 223.

Figure 12:
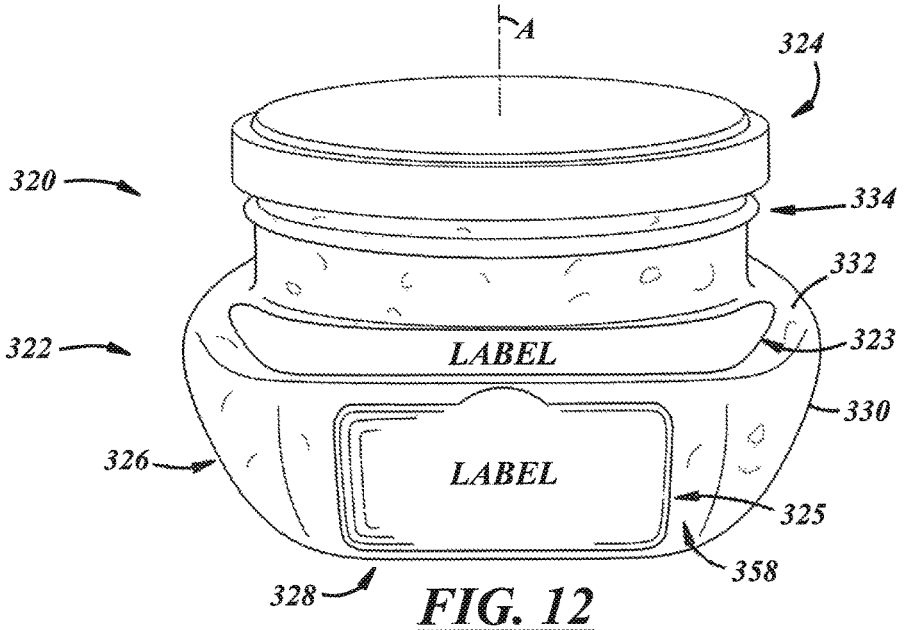
FIG. 12 is a front elevational view of a package including a container and container labels in accordance with an additional illustrative embodiment of the present disclosure, wherein the container is resting on a primary support surface and is filled with product.
Figure 13:
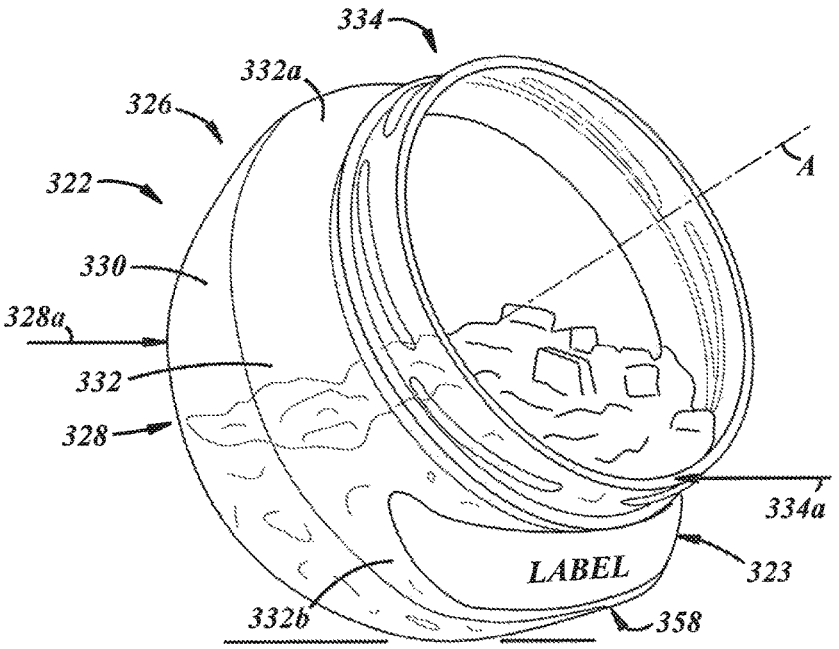
FIG. 13 is a front perspective view of the container and one of the container labels of FIG. 12, wherein the container has been tilted onto a secondary support surface to facilitate access to partially consumed product in the container.

FIGS. 12 and 13 illustrate another illustrative embodiment of a package 320 including a container 322. This embodiment is similar in many respects to the embodiments of FIGS. 1-11 and like numerals between the embodiments generally designate like or corresponding elements throughout the several views of the drawing figures. Accordingly, the descriptions of the embodiments are incorporated into one another. Additionally, the description of the common subject matter generally may not be repeated here.

FIG. 12 illustrates the container 322, a first label 323 and a second label 325 on the container 322, and a closure 324 coupled to the container 322. The container 322 includes a body 326 including a base 328, a sidewall 330 extending in a direction axially away from the base 328, and a shoulder 332. The container 322 also has a longitudinal axis A, and includes a neck finish 334 extending from the shoulder 332 of the body 326.

The base 328 may define or include a primary support surface that may be flat to establish a plane. The primary support surface may be continuously planar, or may be recessed, for example, to have a push-up (not shown), which may be concave.

The sidewall 330 may have a generally bowl-shaped or rounded outer profile. The sidewall 330 may be faceted, for example, to include at least one secondary support surface 358 that establishes a plane oriented at a non-zero angle to the primary support surface or base 358 and to the axis A. The facet may be continuously planar, for example, wherein the secondary support surface 358 may be a continuously planar surface but, in other embodiments, the facet may be recessed or concave wherein the secondary support surface 358 may be a peripheral rim oriented outside of a concave surface. In any case, the secondary support surface 358 may carry the second label 325. The secondary support surface 358 may intersect the rounded outer profile of the rest of the sidewall 330, and may intersect the base 328 at a tilt angle that is acute with respect to the axis A and obtuse with respect to the base 328. The secondary support surface 358 may be of generally rectangular shape, exemplified by FIG. 12.

With reference to FIG. 13, the consumer may tilt the container 322 from the base 328, and/or a primary support surface thereof, to the secondary support surface 358 to facilitate removal of the remaining product, wherein product may flow under the force of gravity toward the open container mouth. The container 322 is constructed such that when the secondary support surface 358 of the container 322 rests flat on a horizontal surface, a lowermost portion 334*a* of the finish 334 is lower than an uppermost portion 328*a* of the base 328. Compare the straight reference arrow for portion 328*a* with the straight reference arrow for portion 334*a*.

The shoulder 332 extends 360 degrees around the longitudinal axis, is located axially between the neck finish 334 and the secondary support surface 358, and includes a rear portion 332*a* that is a surface of revolution and a front portion 332*b* that is straight and circumferentially aligned with the secondary support surface 358 for securement of the label 323.

Figure 14:
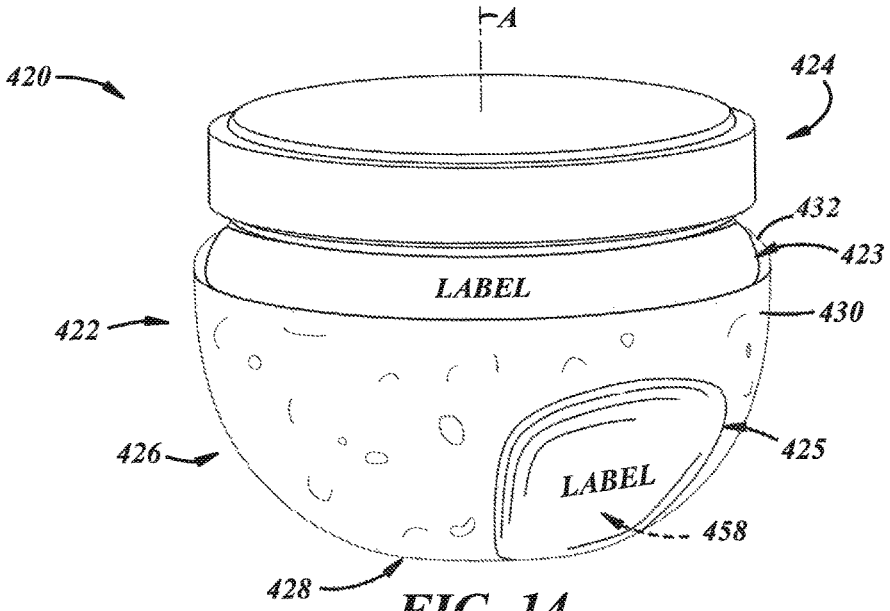
FIG. 14 is a side perspective view of a container in accordance with yet another illustrative embodiment of the present disclosure, wherein the container is resting on a primary support surface and is filled with product.
Figure 15:
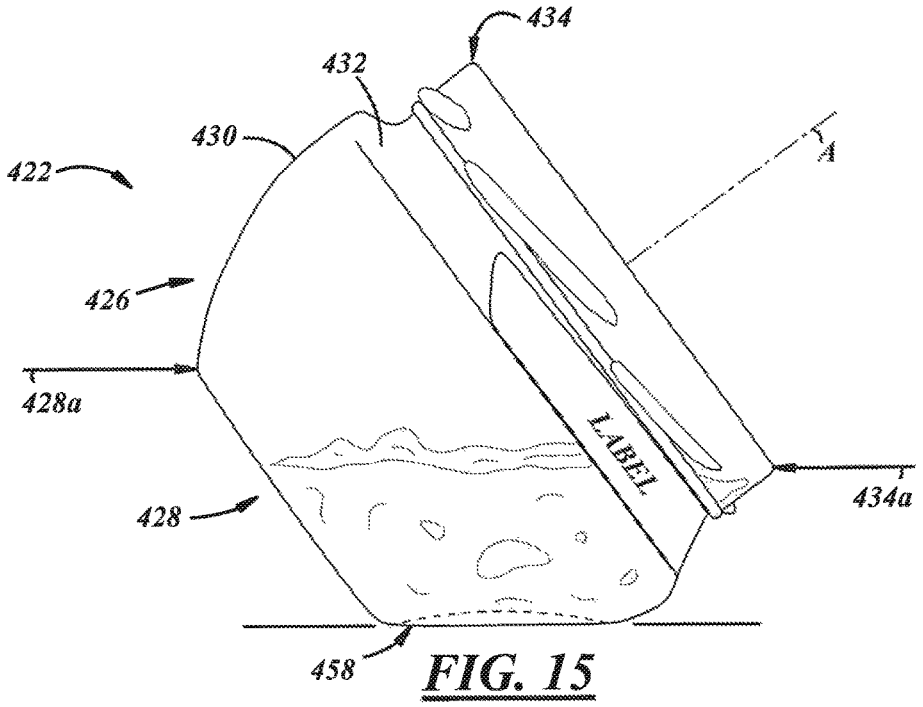
FIG. 15 is a side elevational view of the container of FIG. 14, wherein the container has been tilted onto a secondary support surface to facilitate access to partially consumed product in the container.

FIGS. 14 and 15 illustrate another illustrative embodiment of a package 420 including a container 422. This embodiment is similar in many respects to the embodiments of FIGS. 1-13 and like numerals between the embodiments generally designate like or corresponding elements throughout the several views of the drawing figures. Accordingly, the descriptions of the embodiments are incorporated into one another. Additionally, the description of the common subject matter generally may not be repeated here.

FIG. 14 illustrates the container 422, a first label 423 and a second label 425 on the container 422, and a closure 424 coupled to the container 422. The container 422 includes a body 426 including a base 428, a sidewall 430 extending in a direction axially away from the base 428, and a shoulder 432. The container 422 also has a longitudinal axis A, and includes a neck finish 434 extending from the shoulder 432 of the body 426.

The container is 458 is substantially similar to the bowl-shaped container 358 of FIGS. 12 and 13, except that a secondary support surface 458 may be of irregular shape having a rounded top portion and straight sides. Also, the support surface 458 and second label 425 may have peripheries that coincide with one another wherein the label 425 may be substantially the same shape and size as the support surface, exemplified by FIG. 14.

With reference to FIG. 15, the consumer may tilt the container 422 from the base 428, and/or a primary support surface thereof, to the secondary support surface 458 to facilitate removal of the remaining product, wherein product may flow under the force of gravity toward the open container mouth. The container 422 is constructed such that when the secondary support surface 458 of the container 422 rests flat on a horizontal surface, a lowermost portion 434*a* of the finish 434 is lower than an uppermost portion 428*a* of the base 428. Compare the straight reference arrow for portion 428*a* with the straight reference arrow for portion 434*a*.

Figure 16:
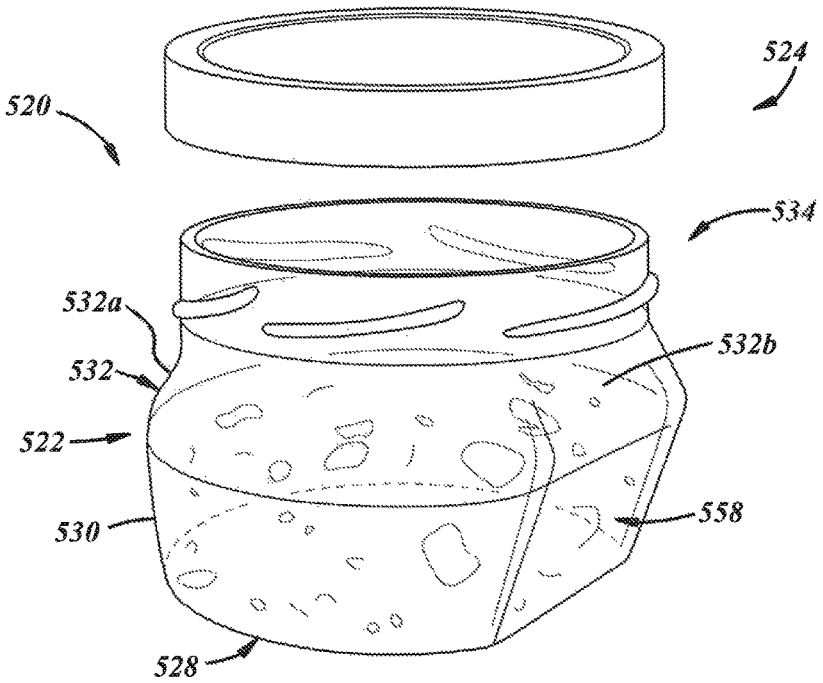
FIG. 16 is a exploded perspective view of a package including a container and closure in accordance with still another illustrative embodiment of the present disclosure, wherein the container is resting on a primary support surface and is filled with product.
Figure 17:
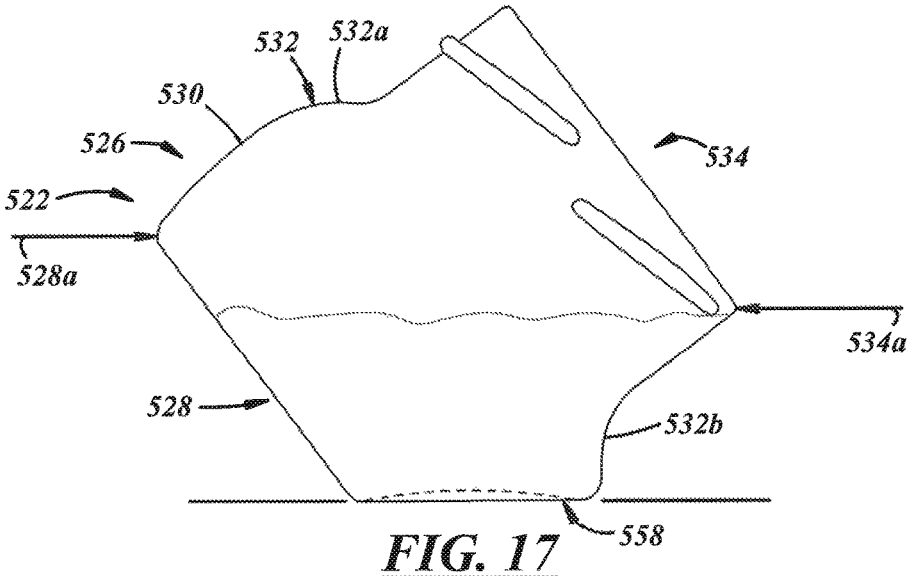
FIG. 17 is a side elevational view of the container of FIG. 16, wherein the container has been tilted onto a secondary support surface to facilitate access to partially consumed product in the container.

FIGS. 16 and 17 illustrate another illustrative embodiment of a package 520 including a container 522. This embodiment is similar in many respects to the embodiments of FIGS. 1-15 and like numerals between the embodiments generally designate like or corresponding elements throughout the several views of the drawing figures. Accordingly, the descriptions of the embodiments are incorporated into one another. Additionally, the description of the common subject matter generally may not be repeated here.

FIG. 16 illustrates the container 522 and a closure 524 coupled to the container 522. The container 522 includes a body 526 including a base 528, a sidewall 530 extending in a direction axially away from the base 528, and a shoulder 532. The container 522 also has a longitudinal axis A, and includes a neck finish 534 extending from the shoulder 532 of the body 526.

The container is 558 is substantially similar to the bowl-shaped container 358 of FIGS. 12 and 13, except that the shoulder 532 may be of irregular shape. For example, the shoulder 532 extends 360 degrees around the longitudinal axis A, is located axially between the neck finish 534 and the secondary support surface 558, and includes a rear portion 532*a* that is a semi-circular surface of revolution and a front portion 532*b* that is straight and circumferentially aligned with the secondary support surface 558 for securement of a label.

With reference to FIG. 17, the consumer may tilt the container 522 from the base 528, and/or a primary support surface thereof, to the secondary support surface 558 to facilitate removal of the remaining product, wherein product may flow under the force of gravity toward the open container mouth. The container 522 is constructed such that when the secondary support surface 558 of the container 522 rests flat on a horizontal surface, a lowermost portion 534*a* of the finish 534 is lower than an uppermost portion 528*a* of the base 528. Compare the straight reference arrow for portion 528*a* with the straight reference arrow for portion 534*a*.

Figure 18:
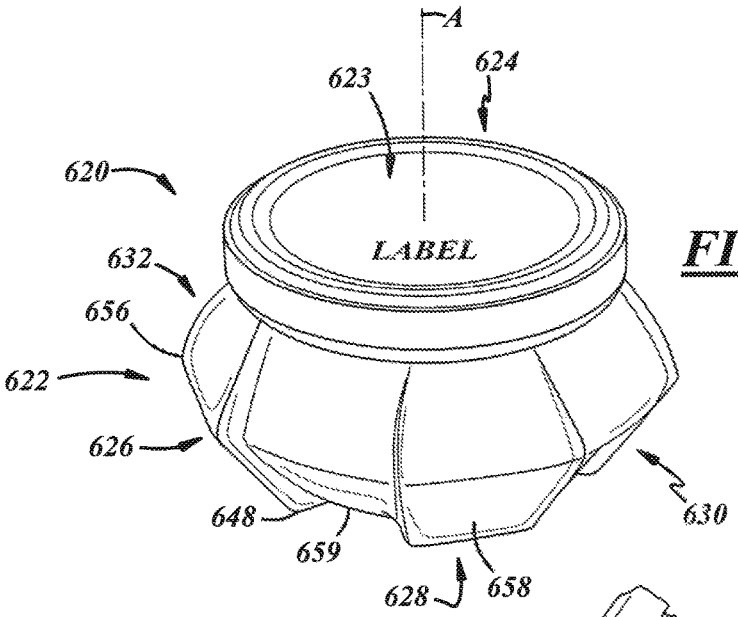
FIG. 18 is a top perspective view of a package including a container, a closure, and a closure label, in accordance with another illustrative embodiment of the present disclosure, wherein the container is resting on a primary support surface and is filled with product.
Figure 19:
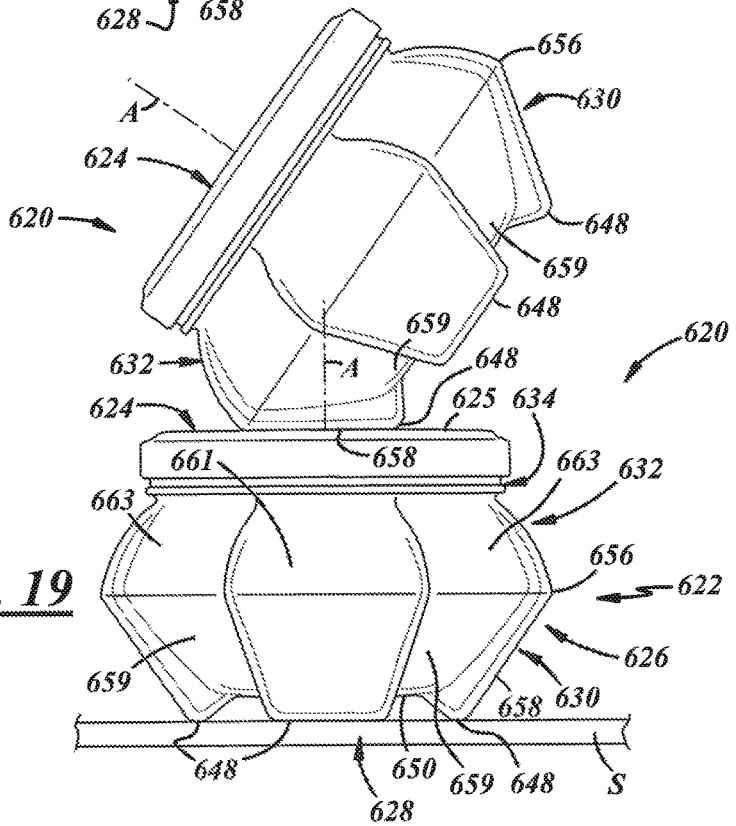
FIG. 19 is a side elevational view of a stack of the package of FIG. 18 supported on a shelf, wherein a top one of the packages has been tilted onto a secondary support surface of the container to facilitate display of the package.

FIGS. 18 and 19 illustrate another illustrative embodiment of a package 620 and/or a container 622 for the package 620. This embodiment is similar in many respects to the embodiments of FIGS. 1-17 and like numerals between the embodiments generally designate like or corresponding elements throughout the several views of the drawing figures. Accordingly, the descriptions of the embodiments are incorporated into one another. Additionally, the description of the common subject matter generally may not be repeated here.

With reference to FIGS. 18 and 19, the package 620 includes a container 622, a closure 624 coupled to the container 622, and a label 623 on the closure 624. The container 622 includes a body 626 including a base 628, a sidewall 630 extending in a direction axially away from the base 628, a surface of revolution or shoulder 632, and a radial apex 656 between the sidewall 630 and shoulder 632. The container 622 also has a longitudinal axis A, and includes a neck finish 634 (FIG. 19) extending from the shoulder 632 of the body 626. The base 628 may define or include a primary support surface 648 that may be flat to establish a plane.

Referring to FIG. 19, the sidewall 630 may be both faceted and rounded. For example, the sidewall 630 may be faceted to include secondary support surfaces 658 that each establish a plane oriented at a non-zero angle to the primary support surface 648 (FIG. 18) and to the axis A. The surfaces 658 render the container 622 generally frusto-conical from the radial apex 656 to the base 628. Each surface 658 may be continuously planar, for example, wherein the secondary support surface 658 may be a continuously planar surface. But in other embodiments, like the embodiment illustrated in FIGS. 8 and 9, each facet may be recessed or concave wherein the secondary support surface 658 may be a peripheral rim oriented outside of a concave surface. Also, the sidewall 630 may include excurvately rounded portions 659 between the surfaces 658, wherein the sidewall may be bowl-shaped between the surfaces 658. In this embodiment, preferably there is no label carried by the container sidewall 630.

Each secondary support surface 658 may be of trapezoidal shape when viewed from a perpendicular angle thereto. Also, each secondary support surface 658 intersects the base 628 and/or primary support surface 648 at a tilt angle with respect to the axis A and at an obtuse angle with respect to the base 628 and/or primary support surface 648.

The surface(s) 648 need not be circumferentially continuous and may include several circumferentially spaced apart edges that may be straight or curved. The base 628 also may be recessed, for example, having a bottom 650 axially recessed with respect to the support surface(s) 648. The bottom 650, like the rounded portions 659, may be bowl-shaped.

The shoulder 632 may include a circumferentially undulating profile, including radially outward portions 661 that may correspond to the secondary support surfaces 658, and radially inward portions 663 that may correspond to the rounded portions 659. Both the radially inward and outward portions 661, 663 may be excurvately rounded.

As shown in FIG. 19, a stocking arrangement includes a first package 620 having its primary support surface 648 adapted to rest on a shelf S, and a second package 620 having one of its secondary support surfaces 658 resting on a top surface 625 of the closure 624 of the first package 620. The stocking arrangement 600 could also include any suitable quantity of additional packages 620 stacked between the first and second packages 620. This stocking arrangement facilitates display of the label 623 (FIG. 18) to a consumer (viewing the arrangement from the left side of FIG. 19). If the containers 622 are transparent, the stocking arrangement also facilitates display of the product carried in the first package 620.

There thus has been disclosed containers that may provide improved access to diminishing product in a container and that fully satisfies all of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A wide mouth food jar that includes:

a base defining a flat primary support surface on which the food jar is restable, and having a concave push-up, a body extending from said base, and a finish extending from said body coaxially with said base around a base/finish axis and having a plurality of closure engagement features, said body having a sidewall having a plurality of facets including a plurality of secondary support surfaces circumferentially spaced apart around said axis with circumferential spaces therebetween and oriented at an obtuse angle to said primary support surface and at an acute angle to said axis, a frusto-conical surface of revolution around said axis between said secondary support surfaces and said finish, and a radial apex between said secondary support surfaces and said surface of revolution, wherein said sidewall is frusto-conical from said radial apex to said finish, and also from said radial apex to said base with an acute conical top angle, and at least one of said secondary support surfaces includes a surface-defining periphery with an edge lying in a plane at an acute angle to said axis onto which the food jar is restable and a concave surface portion within said periphery, wherein the food jar is constructed such that when the secondary support surfaces of the food jar rest flat against a surface, a lowermost portion of the finish is lower than an uppermost portion of the base.

2. The food jar set forth in claim 1 and including a wrap-around label secured to and extending entirely around said surface of revolution.

3. The food jar set forth in claim 1, wherein there are six secondary support surfaces.

4. A wide mouth food jar that includes:

a base defining a flat primary support surface, a body extending from said base, and a finish extending from said body coaxially with said base around a base/finish axis, said body having a sidewall having at least one secondary support surface at an angle to said primary support surface and to said axis, and a surface of revolution around said axis between said secondary support surface and said finish, wherein said at least one secondary support surface includes a surface-defining periphery with an edge lying in a plane at an acute angle to said axis and a concave surface portion within said periphery, wherein said at least one secondary support surface comprises a plurality of secondary support surfaces at a common angle to said axis, and wherein said finish has a plurality of closure engagement features equal in number to said plurality of flat secondary support surfaces and wherein the closure engagement features are oriented in a predetermined circumferential relationship with a plurality of the secondary support surface such that a circumferential center of each closure engagement feature is circumferentially aligned with a circumferential center of a corresponding secondary support surface.

5. A package that includes a wide mouth food jar as set forth in claim 4 and a closure with a skirt having a plurality of internal lugs equal in number to said plurality of closure engagement features.

6. The package set forth in claim 5 wherein said closure has a raised peripheral edge and said base of said wide mouth food jar has a maximum external dimension receivable within said raised peripheral edge such that said packages can be stacked upon each other.

7. A wide mouth food jar that has a longitudinal axis and that includes:

a body including a base having a primary support surface on which the food jar is restable and having a concave push-up, and a sidewall extending from the base and including a plurality of facets having a plurality of secondary support surfaces circumferentially spaced apart around the axis with circumferential spaces therebetween and oriented at an obtuse angle with respect to said primary support surface and at an acute angle to said axis, the secondary support surfaces establishing planes onto which the food jar is restable; and a neck finish extending from the body along and coaxial with the longitudinal axis and including a cylindrical outer surface and one or more closure engagement features on the cylindrical outer surface, said body also including a frusto-conical shoulder oriented at an obtuse angle with respect to the secondary support surfaces and at an acute angle with respect to the longitudinal axis and located axially between the neck finish and the secondary support surfaces, and a radial apex between said secondary support surfaces and said shoulder, wherein said sidewall is frusto-conical from said radial apex to said base with an acute conical top angle, and the food jar is constructed such that when the secondary support surfaces of the food jar rest flat on a horizontal surface, a lowermost portion of the finish is lower than an uppermost portion of the base.

8. A package including the food jar set forth in claim 7, a label carried by the surface of revolution, and a closure coupled to the neck finish.

9. The food jar set forth in claim 7, wherein the secondary support surfaces are of conic sectional shape including at least one of a hyperbolic shape or a parabolic shape.

10. The food jar set forth in claim 7, wherein the secondary support surfaces are of trapezoidal shape.

11. The food jar set forth in claim 7, wherein the size and configuration of the food jar is such that 25% to 40% of a food product by volume is retained in the food jar without spillage when the food jar rests on the secondary support surface.

12. The food jar set forth in claim 7, wherein the neck finish establishes an opening with a diameter of about 100 mm.

13. The food jar set forth in claim 7, wherein there are six secondary support surfaces.

14. A wide mouth food jar that has a longitudinal axis and that includes:

a body including a base having a primary support surface that is axially recessed, and a sidewall extending from the base and including a facet having a secondary support surface that includes a surface-defining periphery with an edge lying in a plane onto which the food jar is restable and being oriented at a tilt angle that is acute with respect to the axis and obtuse with respect to the primary support surface, the facet also having the surface-defining periphery with a concave surface portion within the periphery, said body also including a frusto-conical shoulder oriented at an obtuse angle with respect to the secondary support surfaces and at an acute angle with respect to the longitudinal axis and located axially between the neck finish and the secondary support surfaces, and a radial apex between said secondary support surfaces and said shoulder; and a neck finish extending from the body along and coaxial with the longitudinal axis and including a cylindrical outer surface and one or more closure engagement features on the cylindrical outer surface, wherein the sidewall is both faceted and rounded with the sidewall including a plurality of the secondary support surfaces and a plurality of excurvately rounded portions between the secondary support surfaces and wherein the sidewall is frusto-conical from the radial apex to the finish, and also from the radial apex to the base with an acute conical top angle.

15. The food jar set forth in claim 14, wherein the shoulder also includes a circumferentially undulating profile including radially outward portions and radially inward portions.

16. The food jar set forth in claim 15, wherein the radially outward portions correspond to the secondary support surfaces, and the radially inward portions correspond to the rounded portions.

17. The food jar set forth in claim 15, wherein the radially outward and inward portions are excurvately rounded.

* * * * *